US007931057B2

(12) United States Patent
Chung et al.

(10) Patent No.: US 7,931,057 B2
(45) Date of Patent: Apr. 26, 2011

(54) CUT GUIDE FOR A WORKBENCH SYSTEM

(75) Inventors: Brian Hyuk Joon Chung, Arlington Heights, IL (US); Christopher Heflin, Oak Park, IL (US)

(73) Assignee: Robert Bosch GmbH, Stuttgart (DE)

( * ) Notice: Subject to any disclaimer, the term of this patent is extended or adjusted under 35 U.S.C. 154(b) by 223 days.

(21) Appl. No.: 12/212,984

(22) Filed: Sep. 18, 2008

(65) Prior Publication Data

US 2010/0064873 A1 Mar. 18, 2010

(51) Int. Cl.
*B25H 1/00* (2006.01)

(52) U.S. Cl. .... 144/286.1; 144/2.1; 144/137; 144/286.5

(58) Field of Classification Search ..... 144/286.1–287, 144/2.1, 3.1, 137, 285
See application file for complete search history.

(56) References Cited

U.S. PATENT DOCUMENTS

| | | | | |
|---|---|---|---|---|
| 979,528 | A | 12/1910 | McCormick | |
| 4,054,077 | A | 10/1977 | Gram | |
| 4,265,284 | A * | 5/1981 | Taylor | 144/287 |
| 4,555,099 | A * | 11/1985 | Hilton | 269/88 |
| 4,892,021 | A * | 1/1990 | Sanderson | 83/468 |
| 5,284,331 | A * | 2/1994 | Lee et al. | 269/16 |
| 5,369,364 | A | 11/1994 | Renirie et al. | |
| 5,862,842 | A | 1/1999 | You | |
| 6,148,881 | A | 11/2000 | Valenzuela | |
| 6,524,033 | B1 * | 2/2003 | Sykes | 408/1 R |
| 2009/0065992 | A1 * | 3/2009 | Chung et al. | 269/16 |

* cited by examiner

*Primary Examiner* — Shelley Self
(74) *Attorney, Agent, or Firm* — Maginot, Moore & Beck

(57) ABSTRACT

A workbench system in one embodiment includes a first and a second plurality of dog holes in a planar work surface defining a first and a second axis extending in the work surface plane, and a plurality of cutting guides, each of the plurality of cutting guides including a body defining a first securing portion on a first side of the body and a second securing portion on a second side of the body opposite to the first side, a first stem extending downwardly away from the body and configured to fit into one of the first plurality of holes, and a guide member defining a guide plane which intersects the first axis and the second axis.

13 Claims, 5 Drawing Sheets

CUT GUIDE FOR A WORKBENCH SYSTEM

FIELD OF THE INVENTION

This invention relates to the field of devices used to support work pieces and more particularly to a device for guiding a cutting tool.

BACKGROUND

Workbenches are useful in supporting a work piece such as a piece of lumber or metal. Such devices are frequently provided with a clamping device for securing the work piece. In certain workbenches, a split table top is used to clamp the work piece. Some workbenches further incorporate a pattern of holes into which a user places a dog. The dog, which protrudes out of the hole, provides a surface against which the work piece can be clamped.

A problem which arises with prior art systems is that clamping devices incorporate gear systems to move the device against a work piece. While effective, gear mechanisms are heavy and add to the cost of the device. Additionally, waste particles may fall into the gear mechanism either jamming the gear mechanism or making the gear mechanism more difficult to operate.

In other systems, a work piece is constrained from movement by pressure applied to the sides of the work piece. When shaping the work piece, however, a force is frequently applied in a direction through the upper surface of the work piece. For example, a circular saw may bind in the work piece, thereby applying a pressure tending to lift the work piece off of the workbench. To avoid movement of the work piece off of the workbench as a result of these forces, a substantial amount of pressure must be applied to the sides of the work piece. Such pressure may be acceptable for various metal work pieces; however, the sides of a piece of wood or other relatively soft material may be marred before sufficient force is applied to avoid undesired movement.

Another problem arises when increased accuracy in cutting a work piece is desired. For example, many tasks require a straight edge to be formed in a cut work piece. One approach for obtaining a straight cut is to snap a line using chalk dust or to otherwise mark the surface of the work piece. A cutting tool is then guided by hand along the mark. For projects which do not require a great deal of accuracy, this type of approach may prove adequate. Other projects, however, may require a more accurate cut. One approach to achieving a more accurate cut is to clamp a piece of lumber on top of the work piece and to then use the clamped piece of lumber as a guide. While capable of providing a more accurate cut than free-hand methods, the clamps frequently obstruct the path of the cutting tool.

What is needed is a system which can secure work pieces to a workbench without the need for a gearing mechanism. What is further needed is a system which restrains movement of a work piece off of the surface of a workbench without relying upon pressure applied to the sides of the work piece. What is also needed is a system which assists in making a cut in a work piece which is secured to a workbench.

SUMMARY

In accordance with one embodiment of the present invention, there is provided a workbench system which includes a first and a second plurality of dog holes in a planar work surface defining a first and a second axis extending in the work surface plane, and a plurality of cutting guides, each of the plurality of cutting guides including a body defining a first securing portion on a first side of the body and a second securing portion on a second side of the body opposite to the first side, a first stem extending downwardly away from the body and configured to fit into one of the first plurality of holes, and a guide member defining a guide plane which intersects the first axis and the second axis, wherein the distance between the centerline of the first stem and the first securing portion along a third axis parallel to the guide plane and the working surface plane defines a first side distance, the distance between the centerline of the first stem and the second securing portion along the third axis defines a second side distance, and the distance between the first axis and the second axis along the guide plane is equal to the width of a first commonly sized work piece plus the first side distance plus the second side distance, equal to the width of a second commonly sized work piece plus two times the width of the first side distance, and equal to the width of a third commonly sized work piece plus two times the second side distance, each of the first, second, and third commonly sized work pieces having a width different from each of the other of the first, second, and third commonly sized work pieces.

In accordance with another embodiment, a cutting guide kit for use in a workbench system includes at least one cutting guide with a first securing portion in a first plane and a second securing portion in a second plane substantially parallel to the first securing portion, a first guide portion extending outwardly from above the first securing portion by a first extension distance, a second guide portion extending outwardly from above the second securing portion by a second extension distance, the second extension distance shorter than the first extension distance, and at least one stem configured for insertion into a dog hole in a work surface for coupling the at least one cutting guide to the work surface, the at least one stem defining a longitudinal axis perpendicular to the work surface and parallel to the first plane and the second plane, and positioned such that the shortest distance between the longitudinal axis and the first plane plus the first extension distance is substantially equal to the shortest distance between the longitudinal axis and the second plane plus the second extension distance.

In accordance with yet another embodiment, a workbench system cutting guide includes a coupler defining a coupling axis, a first securing portion defining a first plane on a first side of the cutting guide, a second securing portion defining a second plane parallel to the first plane on a second side of the cutting guide, the first side opposite to the second side, a first guide surface defining a first guide plane that intersects the first plane and the second plane, and a second guide surface defining a second guide plane parallel to the first guide plane, wherein the first plane is closer to the coupling axis than the second plane as measured on a first line extending between the first plane and the second plane and intersecting the coupling axis, and the first guide plane and the second guide plane are equidistant from the coupling axis as measured on a second line extending between the first guide plane and the second guide plane and intersecting the coupling axis.

DESCRIPTION

Figure 1:
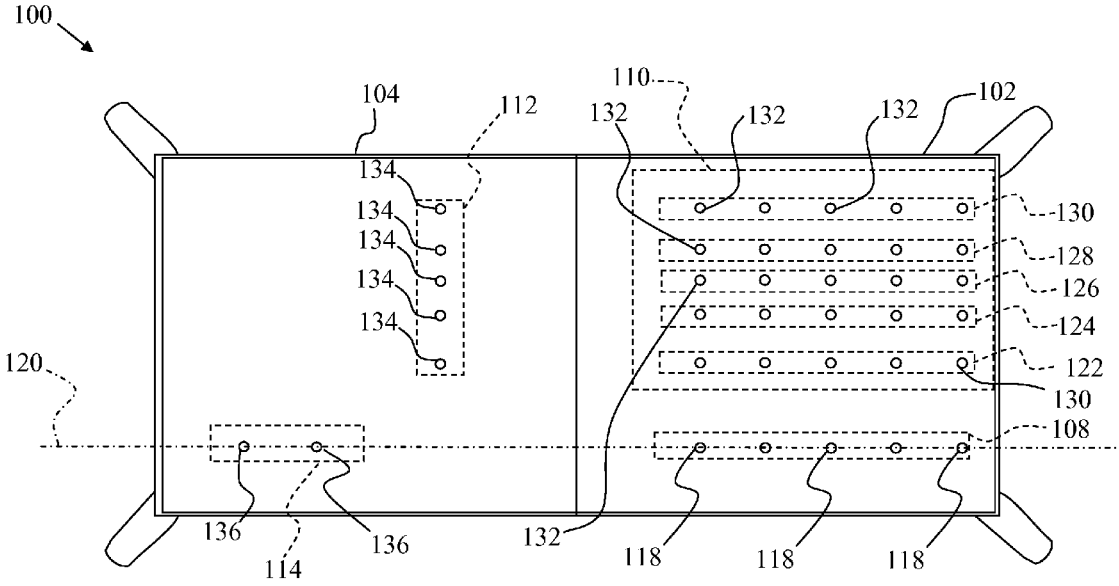
FIG. 1 depicts a top plan view of a workbench in a workbench system incorporating a dog hole pattern in accordance with principles of the present invention.
Figure 2:
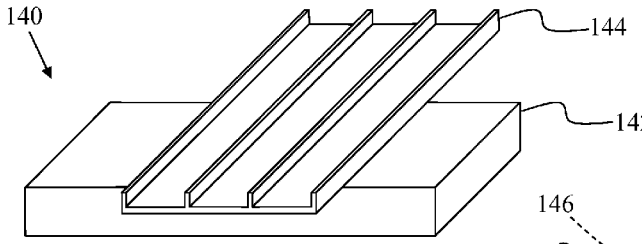
FIG. 2 depicts a perspective view of a cutting guide in the workbench system that can be used in the dog holes of FIG. 1 to secure a work piece and to guide a cutting device in accordance with principles of the present invention.
Figure 3:
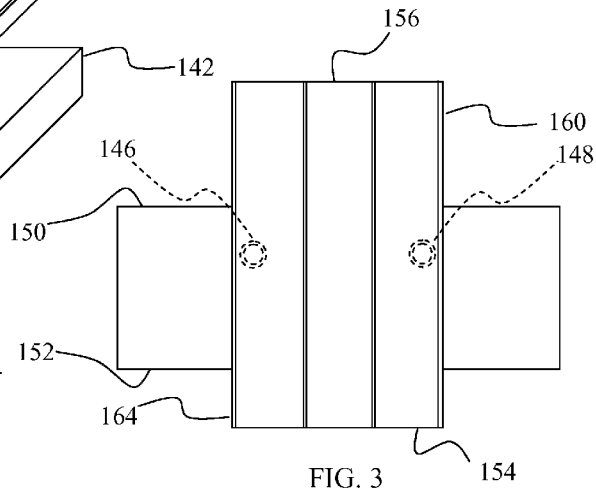
FIG. 3 depicts a top plan view of the cutting guide of FIG. 2.
Figure 4:
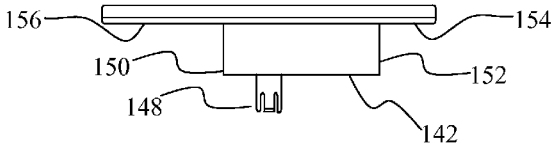
FIG. 4 depicts a side plan view of the cutting guide of FIG. 2.
Figure 5:
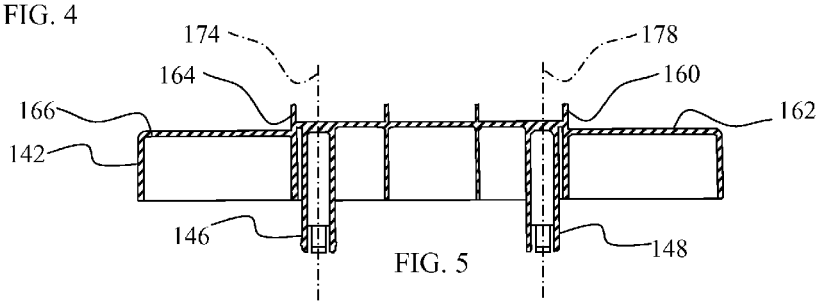
FIG. 5 depicts a cross-sectional view of the cutting guide of FIG. 2.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 shows a top plan view of a workbench 100 that may be used in a workbench system. The workbench 100 includes a movable work surface 102, and a stationary work surface 104. The movable work surface 102 includes a base dog hole portion 108 and a dog hole array 110. The stationary work surface 104 includes a dog hole portion 112 and a dog hole portion 114.

The base dog hole portion 108 in this embodiment includes five dog holes 118. The dog holes 118 define an axis 120 that extends across the generally planar movable work surface 102, and the stationary work surface 104. The dog hole array 110 includes five sets of dog holes 122, 124, 126, 128, and 130. Each set of dog holes 122, 124, 126, 128, and 130 include four dog holes 132. Each of the dog holes 132 within a particular one of the five dog hole sets 122, 124, 126, 128, and 130 are equidistant from the axis 120. Additionally, each of the dog holes 132 is vertically aligned with one of the dog holes 118 as shown in FIG. 1.

The dog hole portion 112 includes five dog holes 134. One of the dog holes 134 is aligned with a respective one of the dog hole sets 122, 124, 126, 128, and 130. That is, the respective dog holes 134 are each spaced apart from the axis 120 by the same distance as the dog holes 132 in a respective one of the dog hole sets 122, 124, 126, 128 and 130. The dog hole portion 114 includes two dog holes 136. The dog holes 136 are aligned with the dog holes 118 in the base dog hole set 108.

FIGS. 2-5 show a cutting guide 140 which is configured for use with the dog holes 118 and 132. The cutting guide 140 includes a body portion 142 and a guide member 144. Two stem couplers 146 and 148 extend downwardly from the body portion 142. The body portion 142 includes a short side securing portion 150 and a long side securing portion 152. A short extension 154 of the guide member 144 extends outwardly from a location above the long side securing portion 152 and a long extension 156 of the guide member 144 extends outwardly from a location above the short side securing portion 150.

The guide member 144 includes a guide surface 160 which extends from the long extension 156, along a slide surface 162 of the body portion 142, to the short extension 154. The guide member 144 further includes a guide surface 164 which extends from the long extension 156, along a slide surface 166 of the body portion 142, to the short extension 154.

The stem couplers 148 and 146 are configured for coupling with the base dog holes 118. In the embodiment of FIGS. 2-5, the stem couplers 148 and 146 are configured to be coupled with adjacent dog holes 118. In alternative embodiments, more or fewer stem couplers may be provided which couple with dog holes which are not adjacent to each other. The configuration of the stem couplers 148 and 146 allows the cutting guide 140 to be removably coupled to the movable work surface 102 in either of two orientations. In one orientation, the cutting guide 140 may be positioned with the short extension 154 closer to the dog hole array 110. In another orientation the cutting guide 140 may be positioned with the long extension 156 closer to the dog hole array 110.

Moreover, a kit may be provided which includes a plurality of additional cutting guides. In one embodiment, the stem couplers of the additional cutting guides are configured to couple with the dog holes 132 in the dog hole array 110 but not in the dog holes 118. This may be accomplished by spacing and/or sizing of the couplers and dog holes. In another embodiment, all of the cutting guides may be configured to couple with all of the dog holes.

Figure 6:
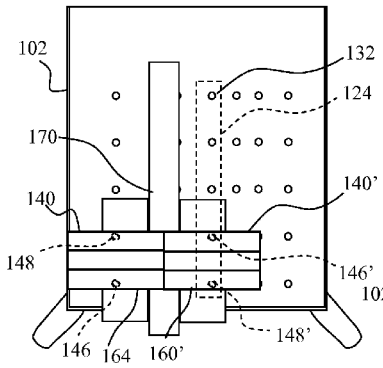
FIG. 6 depicts a top plan view of the workbench of FIG. 1 and a plurality of cutting guides of FIG. 2 securing a work piece.
Figure 7:
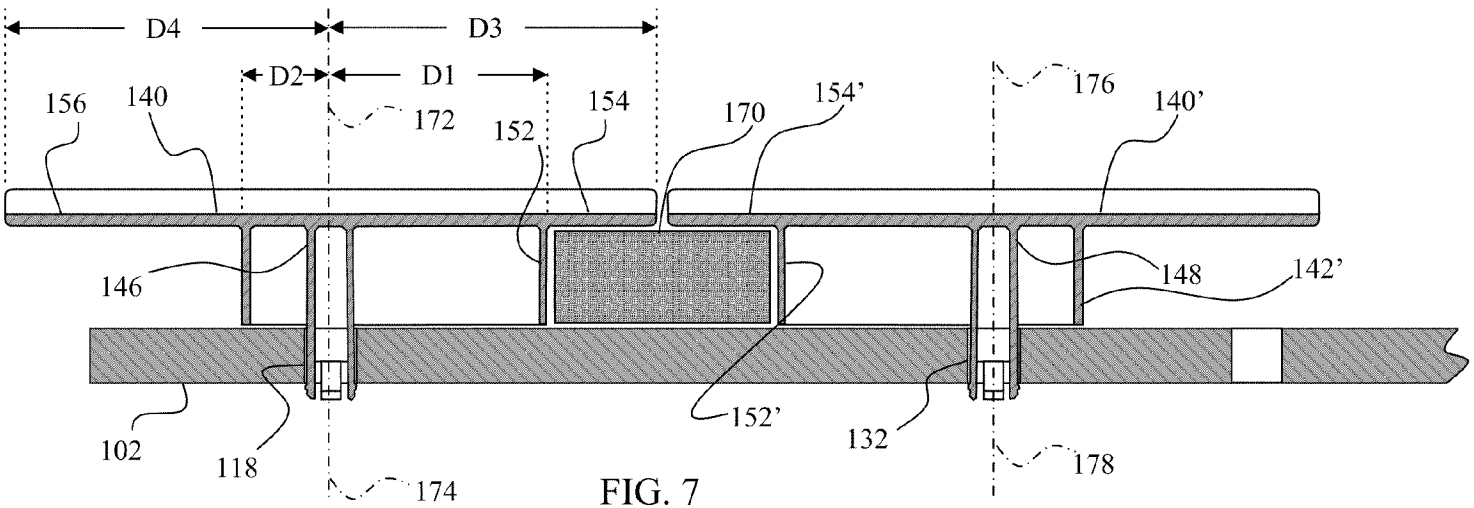
FIG. 7 depicts a partial cross-sectional view of the workbench and cutting guide configuration of FIG. 6 wherein the work piece is secured between the securing portions of the cutting guides, the extensions of the cutting guides, and the work bench.

Accordingly, another cutting guide 140', see FIGS. 6 and 7, may be coupled with the movable work surface 102 using the dog holes 132 in the dog hole set 124 to secure a work piece 170. The cutting guide 140' in this embodiment is identical to the cutting guide 140, and like numbers are used to identify like components. In the configuration of FIGS. 6 and 7, the cutting guide 140' is coupled with the stationary work surface 104 such that the short extension 154' of the cutting guide 140' extends from the base 142' in the direction of the dog holes 118.

Thus, the work piece 170 is secured horizontally between the long side securing portion 152 of the cutting guide 140 and the long side securing portion 152' of the cutting guide 140'. Additionally, movement of the work piece 170 in a direction upwardly away from the movable work surface 102 is restrained by the long extension 156 and the long extension 156' which extend over the work piece 170.

The work piece 170 in this embodiment has a thickness (measured upwardly from the movable work surface 102) of 1.5 inches and a width (measured along an axis which extends between the dog holes 118 and the dog holes 132) of 3.5 inches. The configuration of the dog holes 118 and 132 along with the dimensions of the cutting guide 140 and 140' have been selected to provide a good fit of the work piece 170 between the cutting guide 140, the cutting guide 140' and the movable work surface 102 as discussed with reference to FIG. 7. In FIG. 7, the center line 172 of the hole 118 and the centerline 174 of the stem coupler 146 are coincident. Likewise, the center line 176 of the hole 132 and the centerline 178' of the stem coupler 148' are coincident.

The distance between the centerline 174 of the stem coupler 146 and the outer wall of the long side securing portion 152 (side distance D1) is about 87 millimeters and the distance between the centerline 174 of the stem coupler 146 and the outer wall of the short side securing portion 150 (side distance D2) is about 36 millimeters. Moreover, the distance between the center line 172 of the hole 118 and the center line 176 of the hole 132 is about 263 millimeters.

Accordingly, in the configuration of FIG. 7, the cutting guides 140 and 140' occupy about 174 millimeters of the 263 millimeters between the center line 172 of the hole 118 and the center line 176 of the hole 132, leaving a gap of about 89 millimeters (3.5 inches). Thus, the work piece 170 is tightly held between the cutting guides 140 and 140'. Additionally, the height of the base 142 in this embodiment is 40 millimeters (3.5 inches) which corresponds to the thickness of the work piece 170. Accordingly, the short extensions 154 and 154' hold the work piece 170 securely against the movable work surface 102.

The dimensions of the cutting guides 140 and 140' are further selected such that the distance from the centerline 174 of the stem coupler 146 to the outer end of the slide surface 166 (see FIG. 5) is the same as the distance from the centerline 178 of the stem coupler 148 to the outer end of the slide surface 162. Moreover, as shown in FIG. 7, the distance (D3) from the centerline 174 of the stem coupler 146 to the outer end of the short extension 154 is the same as the distance (D4) from the centerline 174 of the stem coupler 146 to the outer end of the long extension 156. Accordingly, when the cutting guides 140 and 140' are coupled with the movable work surface 102, the members 144 and 144' provide a substantially continuous guide surface. The guide surface 164 and the guide surface 160' thus define a guide plane which is perpendicular to the movable work surface 102. A user may use the guide surfaces 164 and 160' to guide a cutting tool during a shaping operation on the work piece 170.

In one embodiment, the slide surfaces 162/162' and 166/166' are configured to support a cutting tool as the tool is used. In such supporting embodiments, the width of the slide surfaces 162/162' and 166/166' is selected to compliment the stand-off distance between a guide portion of the cutting tool and the blade of the cutting tool. By way of example, circular saws commonly include a bottom plate which defines a stand-off distance of about 88 millimeters between a guide portion of the plate and the blade. Accordingly, the slide surfaces 162/162' and 166/166' may extend outwardly of the guide surfaces 160/160' and 164/164', respectively, by about 88 millimeters.

Figure 8:
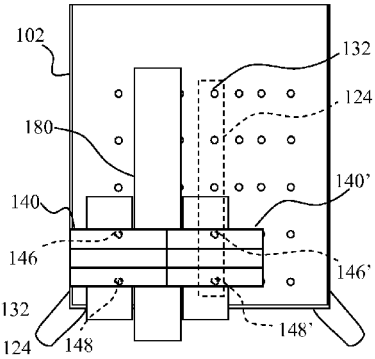
FIG. 8 depicts a top plan view of the workbench of FIG. 1 and a plurality of cutting guides of FIG. 2 securing a work piece that is wider than the work piece of FIG. 6 using the same dog holes that were used in holding the work piece of FIG. 6 but with one of the cutting guides rotated 180 degrees.
Figure 9:
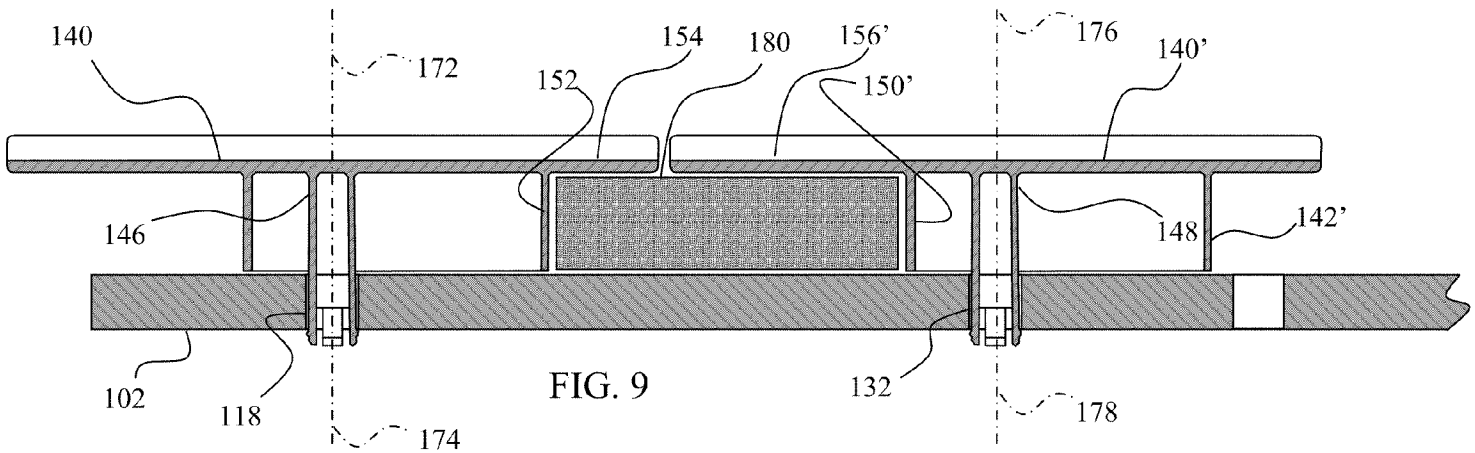
FIG. 9 depicts a partial cross-sectional view of the workbench and cutting guide configuration of FIG. 8 wherein the work piece is secured between the securing portions of the cutting guides, the extensions of the cutting guides, and the work bench.

Work pieces of different dimensions may be secured by differently orienting one or both of the cutting guides 140 and 140.' By way of example, FIGS. 8 and 9 depict the cutting guides 140 and 140' used to secure a work piece 180. The work piece 180 in this embodiment has a thickness of 1.5 inches and a width of 5.5 inches. In FIG. 9, the cutting guide 140 is in the same configuration of FIG. 7, with the long side securing portion 152 closest to the dog holes 132. The cutting guide 140', however, has been rotated by 180 degrees such that the short side securing portion 150' is closest to the dog holes 118, while the stem couplers 146' and 148' are inserted into dog holes 132 in the dog hole set 124.

Based upon the dimensions discussed above with respect to FIG. 7, in the configuration of FIG. 9, the cutting guides 140 and 140' occupy about 123 millimeters of the 263 millimeters between the center line 172 of the hole 118 and the center line 176 of the hole 132, leaving a gap of about 140 millimeters, which is slightly more than 5.5 inches. Thus, the work piece 170 is securely held between the cutting guides 140 and 140' and the movable work surface 102.

While the dimensions of the work pieces 170 and 180 are substantially the same as the dimensions of commonly sized piece of lumber such as a 2×4 and a 2×8, respectively, many work pieces, such as lumber, will frequently be dimensioned differently from the nominal size. For example, a 2×4 piece of lumber has a nominal thickness of 1.5 inches and a width of 3.5 inches. The actual thickness and width, however, will vary based upon the moisture content and other tolerances. Warping of a wood work piece may add further variances. Accordingly, for many applications the designed gap between the securing portions and the height of the extensions above the work surface are preferably selected to be larger than the nominal dimensions of the work pieces with which the cutting guides will be used.

Figure 10:
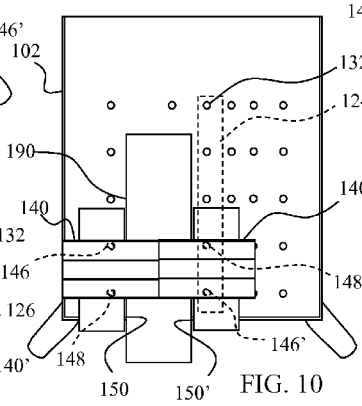
FIG. 10 depicts a top plan view of the workbench of FIG. 1 and a plurality of cutting guides of FIG. 2 securing a work piece that is wider than the work piece of FIG. 6 and wider than the work piece of FIG. 8 using the same dog holes that were used in holding the work pieces of FIGS. 6 and 8 but with both of the cutting guides rotated 180 degrees from the orientation of the cutting guides in FIG. 6.

Referring to FIG. 10, the work piece 190 in this embodiment has a thickness of 1.5 inches and a width of 7.25 inches which corresponds to the nominal dimensions of a 2×8 piece of lumber. In FIG. 10, the cutting guide 140' is in the same configuration as FIG. 9, with the short side securing portion 150' closest to the dog holes 118. The cutting guide 140, however, has been rotated by 180 degrees such that the short side securing portion 150 is closest to the dog holes 132.

Based upon the dimensions discussed above with respect to FIG. 7, in the configuration of FIG. 10, the cutting guides 140 and 140' occupy about 72 millimeters of the 263 millimeters between the center line 172 of the hole 118 and the center line 176 of the hole 132, leaving a gap of about 191 millimeters, which is about ¼ inch larger than the nominal width of a 2×8 piece of lumber. Accordingly, the work piece 190 is securely held between the cutting guides 140 and 140' and the movable work surface 102.

Figure 11:
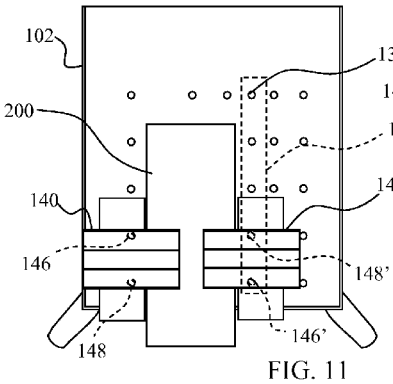
FIG. 11 depicts a top plan view of the workbench of FIG. 1 and a plurality of cutting guides of FIG. 2 securing a work piece that is wider than the work piece of FIG. 10 using different dog holes than were used in holding the work piece of FIG. 10.

Thus, the cutting guides 140 and 140' may used to secure work pieces of three different widths while using dog holes 118 in the base dog hole portion 108 and dog holes 132 in the dog hole set 124. Additional widths of work pieces may be accommodated by the use of the dog holes 132 in the dog hole set 126 as shown in FIG. 11. The dog holes 132 in the dog hole set 126 are spaced 358 millimeters away from the axis 120 (see FIG. 1). Accordingly, the axis 202 of the dog hole 132 shown in FIG. 12 is 358 millimeters away from the axis 172 of the dog hole 118 when viewed in cross section.

Figure 12:
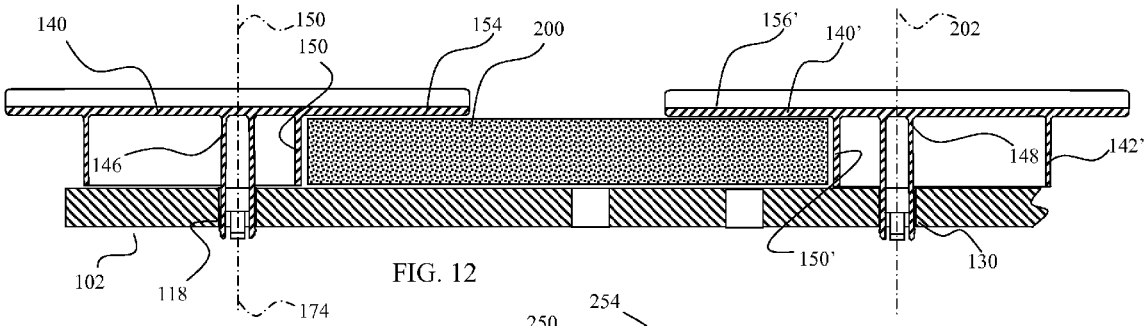
FIG. 12 depicts a partial cross-sectional view of the workbench and cutting guide configuration of FIG. 11 wherein the work piece is secured between the securing portions of the cutting guides, the extensions of the cutting guides, and the work bench.

In FIG. 11, the cutting guide 140' is coupled onto the movable work surface 102 with the short side securing portion 150' closest to the dog holes 118 as shown in FIG. 12. The cutting guide 140 is coupled onto the movable work surface 102 such that the short side securing portion 150 is closest to the dog holes 132. Based upon the dimensions discussed above with respect to the cutting guides 140 and 140', in the configuration of FIG. 11, the cutting guides 140 and 140' occupy about 72 millimeters of the 358 millimeters between the center line 172 of the hole 118 and the center line 202 of the hole 132, leaving a gap of about 286 millimeters, which is about the nominal width of a 2×12 piece of lumber. The work piece 200 in this embodiment has a thickness of 1.5 inches and a width of 11.25 inches which corresponds to the nominal dimensions of a 2×12 piece of lumber. Accordingly, the work piece 200 is securely held between the cutting guides 140 and 140' and the movable work surface 102.

Figure 13:
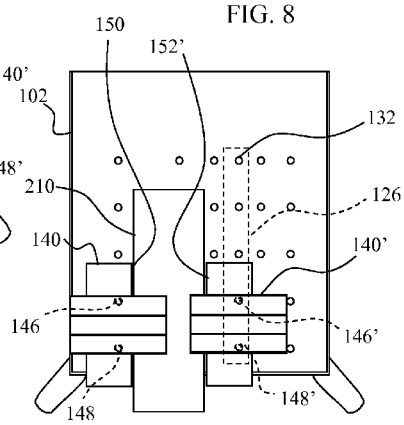
FIG. 13 depicts a top plan view of the workbench of FIG. 1 and a plurality of cutting guides of FIG. 2 securing a work piece that is narrower than the work piece of FIG. 12 using the same dog holes that were used in holding the work pieces of FIG. 11 but with one of the cutting guides rotated 180 degrees from the orientation of the cutting guides in FIG. 12.

Moreover, the orientation at which the cutting guides 140 and 140' are coupled to the movable work surface 102 may be modified to secure work pieces with other widths. In FIG. 13, for example, the cutting guide 140 is coupled onto the movable work surface 102 such that the short side securing portion 150 is closest to the dog holes 132 while the cutting guide 140' is coupled onto the movable work surface 102 with the long side securing portion 152' closest to the dog holes 118. The cutting guides 140 and 140' thus occupy about 123 millimeters of the 358 millimeters between the center line 172 of the hole 118 and the center line 202 of the hole 132, leaving a gap of about 235 millimeters, which is about the nominal width of a 2×10 piece of lumber. Accordingly, the work piece 210, which has a width of about 9.25 inches, is securely held between the cutting guides 140 and 140'.

In the configuration of FIGS. 11 and 12, the guide surfaces 160 and 164' provide a substantially continuous guide surface which includes a gap of about 95 millimeters. Since the guide portion of a circular saw is generally more than 95 millimeters, the guide portion of the circular saw will remain in contact with at least one of the guide surfaces 160 and 164' as the work piece is cut.

The cutting guides 140 and 140' may also be used to cut work pieces of different thicknesses. To this end, a kit including the cutting guides 140 and 140' may include a plurality of shims of one or more thicknesses. By inserting a shim between the cutting guides 140/140' and the movable work surface 102, the height of the slide surfaces 162/162' and 164/164' above the movable work surface 102 may be increased. In embodiments using shims, the stem couplers may be modified to provide adequate coupling. Alternatively, cutting guides with slide surfaces of different heights may be included in a kit to accommodate work pieces with different thicknesses.

Figure 14:
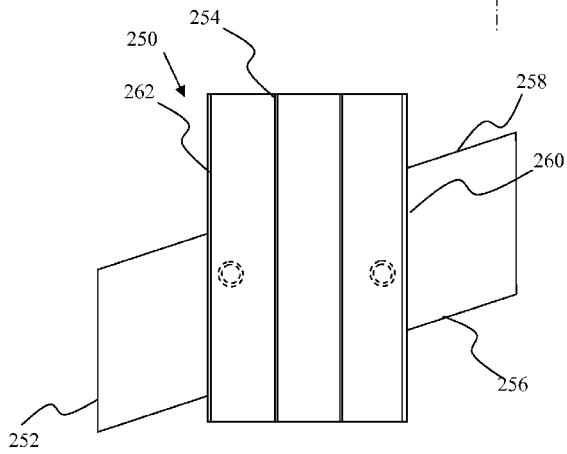
FIG. 14 depicts a perspective view of an alternative cutting guide that can be used in the dog holes of FIG. 1 to guide an angle cut in accordance with principles of the present invention.

The cutting guide 250 shown in FIG. 14 may be used to secure a work piece while defining a guide plane that may be used to make an angled cut along the length of a work piece. The cutting guide 250 includes a body portion 252 and a guide member 254. The body portion includes two securing portions 256 and 258. The guide member 254 includes a guide surface 260 and a guide surface 262. The guide surfaces 260 and 262 are angled with respect to the securing portions 256 and 258. That is, the guide surfaces 260 and 262 intersect the securing portions 256 and 258, when viewed from the top as in FIG. 14, at an angle other than 90 degrees.

When coupled to the movable work surface 102 in a manner similar to the coupling of the cutting guide 140, the guide planes defined by the guide surfaces 260 and 262 are thus angled with respect to a work piece secured therewith. Accordingly, a cutting device may be guided by the guide surfaces 260 and 262 while making an angled cut, i.e., a cut across the work piece at an angle other than 90 degrees, using the cutting guide 250.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A workbench system comprising:

a first and a second plurality of dog holes in a planar work surface, the first and second plurality of dog holes defining a respective first and second axis in the planar work surface, the first and the second axis extending in a parallel fashion in the work surface plane; and a plurality of cutting guides, each of the plurality of cutting guides including (i) a body defining a first securing portion on a first side of the body and a second securing portion on a second side of the body opposite to the first side, (ii) a first coupler fixedly positioned with respect to the body and configured to couple with one of the first plurality of holes such that the first securing portion and the second securing portion are substantially parallel with the first axis, and (iii) a guide member defining a guide plane which intersects the first axis and the second axis when the cutting guide is coupled to the work surface, wherein the distance between a centerline of the first coupler and the first securing portion along a third axis perpendicular to the centerline and the first securing portion defines a first side distance, the distance between the centerline of the first coupler and the second securing portion along the third axis defines a second side distance, and the minimum distance between the first axis and the second axis is (i) substantially equal to the width of a first commonly sized work piece plus the first side distance plus the second side distance, (ii) substantially equal to the width of a second commonly sized work piece plus two times the width of the first side distance, and iii) substantially equal to the width of a third commonly sized work piece plus two times the second side distance, each of the first, second, and third commonly sized work pieces having a width different from each of the other of the first, second, and third commonly sized work pieces.

2. The workbench system of claim 1, each of the plurality of cutting guides further comprising:

a second coupler configured to couple with a second of the first plurality of holes.

3. The workbench system of claim 1, wherein the guide member comprises:

a first guide portion extending over the first securing portion; and a second guide portion extending over the second securing portion.

4. The workbench system of claim 3, wherein the first guide portion and the second guide portion form a substantially continuous guide surface.

5. The workbench system of claim 3, wherein:

the first guide portion extends outwardly of the first securing portion by a first extension distance;

the second guide portion extends outwardly of the second securing portion by a second extension distance; and the first extension distance plus the first side distance is substantially equal to the second extension distance plus the second side distance.

6. The workbench system of claim 3, wherein:

the first side distance is about 36 millimeters; and the second side distance is about 87 millimeters.

7. The workbench system of claim 6, wherein the minimum distance between the first axis and the second axis is about 263 millimeters.

8. The workbench system of claim 6, wherein the minimum distance between the first axis and the second axis is about 358 millimeters.

9. A cutting guide kit for use in a workbench system including at least one cutting guide, the at least one cutting guide comprising:

a first securing portion defined in a first plane and a second securing portion defined in a second plane and substantially parallel to the first securing portion;

a first guide portion extending away from the second plane from above the first securing portion by a first extension distance along an extension axis perpendicular to the second plane;

a second guide portion extending away from the first plane from above the second securing portion by a second extension distance along the extension axis, the second extension distance shorter than the first extension distance; and at least one stem configured for insertion into a dog hole in a work surface for coupling the at least one cutting guide to the work surface, the at least one stem defining a longitudinal axis perpendicular to the work surface and parallel to the first plane and the second plane, and positioned such that the shortest distance between the longitudinal axis and the first plane plus the first extension distance is substantially equal to the shortest distance between the longitudinal axis and the second plane plus the second extension distance, each of the first securing portion, the second securing portion, the first guide portion, the second guide portion, and the stem in fixed relationship with the other of the first securing portion, the second securing portion, the first guide portion, the second guide portion, and the stem.

10. The cutting guide kit of claim 9, wherein the shortest distance between the longitudinal axis and the first plane is more than twice the shortest distance between the longitudinal axis and the second plane.

11. The cutting guide kit of claim 9, the at least one cutting guide further comprising:

a base portion for contacting the work surface, wherein the lower surface of the first guide portion is positioned about 40 millimeters above a plane defined by the work surface when the cutting guide is coupled to the work surface and the base portion is in contact with the work surface.

12. The cutting guide kit of claim 9, wherein the at least one cutting guide comprises a plurality of cutting guides.

13. The cutting guide kit of claim 9, further comprising:

at least one shim, configured to be positioned between the at least one cutting guide and the work surface.

* * * * *